US010215154B2

(12) United States Patent
Gilbert

(10) Patent No.: US 10,215,154 B2
(45) Date of Patent: Feb. 26, 2019

(54) ECCENTRICALLY PILOTED HYDRAULIC COMMUTATOR

(71) Applicant: Parker-Hannifin Corporation, Cleveland, OH (US)

(72) Inventor: Kenneth Todd Gilbert, Bristol, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 132 days.

(21) Appl. No.: 15/285,996

(22) Filed: Oct. 5, 2016

(65) Prior Publication Data

US 2017/0159439 A1 Jun. 8, 2017

Related U.S. Application Data

(60) Provisional application No. 62/262,556, filed on Dec. 3, 2015.

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F03C 2/08*** | (2006.01) |
| ***F01C 21/10*** | (2006.01) |
| ***F04C 2/10*** | (2006.01) |
| ***F04C 14/14*** | (2006.01) |

(Continued)

(52) U.S. Cl.

CPC ..... *F03C 2/08* (2013.01); *F01C 21/108* (2013.01); *F04C 2/103* (2013.01); *F04C 2/104* (2013.01); *F04C 14/14* (2013.01); *F04C 14/24* (2013.01); *F04C 15/06* (2013.01)

(58) Field of Classification Search

CPC ..... F01C 1/34; F01C 21/08; F01C 21/106; F01C 2021/12; F04C 2/103; F04C 2/104; F04C 14/14; F04C 14/24; F04C 15/06; F03C 2/08

USPC ..... 418/61.1, 61.3, 131–132, 171, 166, 418/186–188

See application file for complete search history.

(56) References Cited

U.S. PATENT DOCUMENTS 3,452,543 A * 7/1969 White, Jr. ..... F04C 2/104 418/61.3

3,846,051 A * 11/1974 McDermott ..... F04C 2/104 418/61.3

(Continued)

*Primary Examiner* — Theresa Trieu

(74) *Attorney, Agent, or Firm* — Renner, Otto, Boisselle & Sklar, LLP

(57) ABSTRACT

A hydraulic motor includes a rotor and a stator, wherein the rotor and the stator define a plurality of motor pockets for receiving a flow of hydraulic fluid, and the rotor rotates relative to the stator based on a pressure differential between the motor pockets. A commutator having porting controls the flow of hydraulic fluid into the motor pockets. The rotor rotates about a first axis and the stator orbits about a second axis, and the stator is configured to orbit such that the second axis orbits about the first axis. The commutator is eccentrically piloted about the first axis and the second axis so that the commutator both rotates and orbits to control the flow of hydraulic fluid into the motor pockets. With such configuration, an output shaft is driven by rotation of the rotor about the first axis without orbiting, obviating the need for a drive link.

20 Claims, 18 Drawing Sheets

(51) Int. Cl.
*F04C 14/24* (2006.01)
*F04C 15/06* (2006.01)

(56) References Cited

U.S. PATENT DOCUMENTS 4,219,313 A * 8/1980 Miller ..... F04C 2/104
418/61.3
RE31,067 E * 10/1982 Roberts ..... F04C 2/104
418/61.3

* cited by examiner

ECCENTRICALLY PILOTED HYDRAULIC COMMUTATOR

RELATED APPLICATIONS

This application claims the benefit of U.S. Provisional Application No. 62/262,556 filed Dec. 3, 2015, which is incorporated herein by reference.

FIELD OF INVENTION

The present invention relates generally to hydraulic motors, and more particularly to hydraulic motors including a rotor that rotates relative to a stator to drive an output shaft in a hydraulic fluid system, and a commutator that controls the hydraulic fluid flow through the motor.

BACKGROUND

Hydraulic fluid systems are utilized to generate power in a variety of industries. Mining and drilling equipment, construction equipment, motor vehicle transmission systems, and various other industrial applications employ such hydraulic systems. In hydraulic driving or control, a hydraulic pump pumps hydraulic fluid to a hydraulic motor with an output shaft that drives rotation of an end use element (e.g., wheel axle, gear box, rotating fan, or other suitable usage). The motor output that drives the output shaft is regulated through the control of hydraulic fluid flow through the system.

One type of hydraulic motor is commonly referred to as a gerotor motor. In a basic configuration of a hydraulic gerotor motor, a rotating element or rotor rotates relative to an outer element or stator. Surface features on the diameter surfaces of the rotor relative to the stator create variable displacement windows or pockets for the entry and exit of hydraulic fluid that is pumped through the motor via the action of a hydraulic fluid pump. Pressure differentials among the windows or pockets cause the rotor to rotate relative to the stator, and such rotation in turn drives the rotation of an output shaft. The control of fluid flow into the motor pockets is controlled by porting in a commutator or timing valve. Positioning of the commutator or timing valve causes the porting to supply different motor pockets with hydraulic fluid in a progressive manner around the periphery of the rotor in such a way as to maintain pressure in the correct pockets to maintain further motion of the rotor.

One conventional type of hydraulic gerotor motor is commonly referred to as a Ross motor (named for its principal inventor). In a Ross motor, the rotor is provided with a plurality of lobes that rotate relative to a plurality of vanes provided in the stator. In an exemplary configuration, the rotor has six lobes that rotate to mesh and interact with seven vanes on the stator. For the lobes of the rotor to effectively mesh with the vanes of the stator, the stator is essentially fixed and the rotor rotates eccentrically, meaning that the rotor orbits within the stator as well as rotates. However, the orbiting movement of the rotor must be converted to a pure rotation of the output shaft so as to provide a smooth driving of the output shaft. To accomplish this pure rotational output, a drive link is provided that effects a link between the rotor and the output shaft. The drive link operates to convert the orbiting of the rotor to a pure rotation of the output shaft. The addition of a drive link, however, has a drawback in that such additional component is required for the motor, which increases cost and size, and provides another potential point of maintenance or failure of the motor. Furthermore, the stator tends to be more difficult to machine than the rotor, so having the vanes on the stator presents a relatively large complex and expensive manufacturing process.

In a conventional Ross motor, a timing valve is provided for precise timing of the flow into and out from the motor pockets. The flow paths through the timing valve tend to be spiraled so as to provide the precise timing in a minimal amount of space. The spiral flow paths, however, also may be restrictive creating flow losses and potentially limiting the size of the motor pockets. In a variation on the basic Ross motor, still having the vanes on the stator and lobes on the rotor, a timing valve is provided at the end of a second drive link. As referenced above, a first drive link converts the orbiting movement of the rotor to a pure rotation of the output shaft. In the variation, a second drive link ensures pure rotation of the timing valve for proper timing of flow into and out from the motor pockets. The valve system variation from the conventional Ross motor configuration permits the use of essentially straight ports through the timing valve, which in turn permits relatively large motor windows or pockets. This increases the power potential for a given flow rate of hydraulic fluid as compared to a conventional Ross motor. The use of a second drive link, however, further increases size which can be unsuitable for certain applications, and constitutes an additional potential point of maintenance or failure of the motor.

Another conventional type of hydraulic gerotor motor is commonly referred to as a Nichols motor (also named for its principal inventor). In a Nichols motor, the configuration of the vanes and lobes is basically reversed as compared to a Ross motor. The Nichols rotor is provided with a plurality of vanes that rotate relative to a plurality of lobes provided in the stator. In a Nichols motor, the rotor only rotates in a pure fashion, without any orbiting motion. To maximize the mesh interaction of the vanes and lobes, the stator in the Nichols motor orbits within an outer housing. Because the rotor only rotates, the rotor's motion may be imparted directly to the output shaft, thereby eliminating the need for the additional component of the drive link. By providing the vanes on the rotor, machining the stator is more efficiently accomplished as compared to the Ross motor. In addition, by avoiding the drive link a size reduction is accomplished, although Nichols motors tend to have a larger diameter due to the additional housing in which the stator orbits.

A conventional Nichols motor has a timing system comparable to that of a conventional Ross motor. In this manner, the second drive link of the alternative timing valve configuration likewise is avoided to reduce overall size. The Nichols motor, however, has a drawback in that the vanes-rotor/lobes-stator configuration, combined with the orbiting stator, reduces the potential window or pocket size for a given size motor as compared to a motor with a drive link driven timing valve. To achieve comparable power as a similarly sized motor with a Ross lobe/vane configuration combined with a drive link driven timing valve, the flow rate of hydraulic fluid in the Nichols motor must be increased, which in turn increases undesirable flow losses.

Conventional motor configurations, therefore, have drawbacks. A user, for example, must balance the larger pockets but the need for multiple additional drive links against the elimination of the drive links but the higher flow rate and losses of the Nichols motor. The need to choose between associated advantages and deficiencies of conventional hydraulic motors is undesirable.

SUMMARY OF INVENTION

The present invention provides a hydraulic gerotor configuration that overcomes the deficiencies of conventional configurations. The motor of the present invention achieves relatively large window or pocket size that results in a comparable output power as a Ross motor configuration adapted with a drive link driven timing valve, without the need of the additional drive link components as achieved in a Nichols motor. In other words, the present invention achieves the advantages of the conventional types of motors without the associated drawbacks. Generally, the configuration of the present invention achieves such enhancements by employing an eccentrically piloted commutator, which both rotates and orbits to control the flow of hydraulic fluid into the motor.

In the motor of the present invention, the rotor includes a plurality of lobes and the stator includes a plurality of vanes (similarly as the Ross motor), while having a large window or pocket size. In addition, the rotor only rotates so as to eliminate the need for one or more additional drive link components (similarly as the Nichols motor). To maximize the mesh interaction of the vanes and lobes, in the motor of present invention the commutator is configured as an eccentrically piloted hydraulic commutator. In other words, the commutator element both orbits and rotates within an outer stator ring to control the flow of hydraulic fluid into the motor pockets. The combined rotation and orbiting of the commutator causes the porting to supply different motor pockets with hydraulic fluid in a progressive manner around the periphery of the rotor in such a way as to maintain pressure in the correct pockets to maintain further pure rotation of the rotor. The rotation of the motor can therefore be imparted directly to a drive shaft without using an additional drive link, and with high output power and efficiency due to the large motor pocket size.

An aspect of the invention, therefore, is a hydraulic motor. In exemplary embodiments, the hydraulic motor includes a rotor and a stator, wherein the rotor and the stator define a plurality of motor pockets for receiving a flow of hydraulic fluid, and the rotor is configured to rotate relative to the stator based on a pressure differential between the motor pockets. A commutator having porting is configured to control the flow of hydraulic fluid into the motor pockets. The rotor is configured to rotate about a first axis and the stator is configured to rotate about a second axis, and the stator is configured to orbit such that the second axis orbits about the first axis. The commutator is eccentrically piloted about the first axis and the second axis so that the commutator both rotates and orbits to control the flow of hydraulic fluid into the motor pockets.

The porting of the commutator may include an inner commutator port configured to supply hydraulic fluid to the motor pockets at a first pressure, and an outer commutator port configured to supply hydraulic fluid to the motor pockets at a second pressure different from the first pressure to create the pressure differential between the motor pockets. The inner commutator port may extend through an entire longitudinal thickness of the commutator, and the outer commutator port may extend partially through the longitudinal thickness of the commutator. The commutator has a slot that forms a fluid pathway between the outer commutator port and an outer diameter of the commutator.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

DETAILED DESCRIPTION

Figure 1:
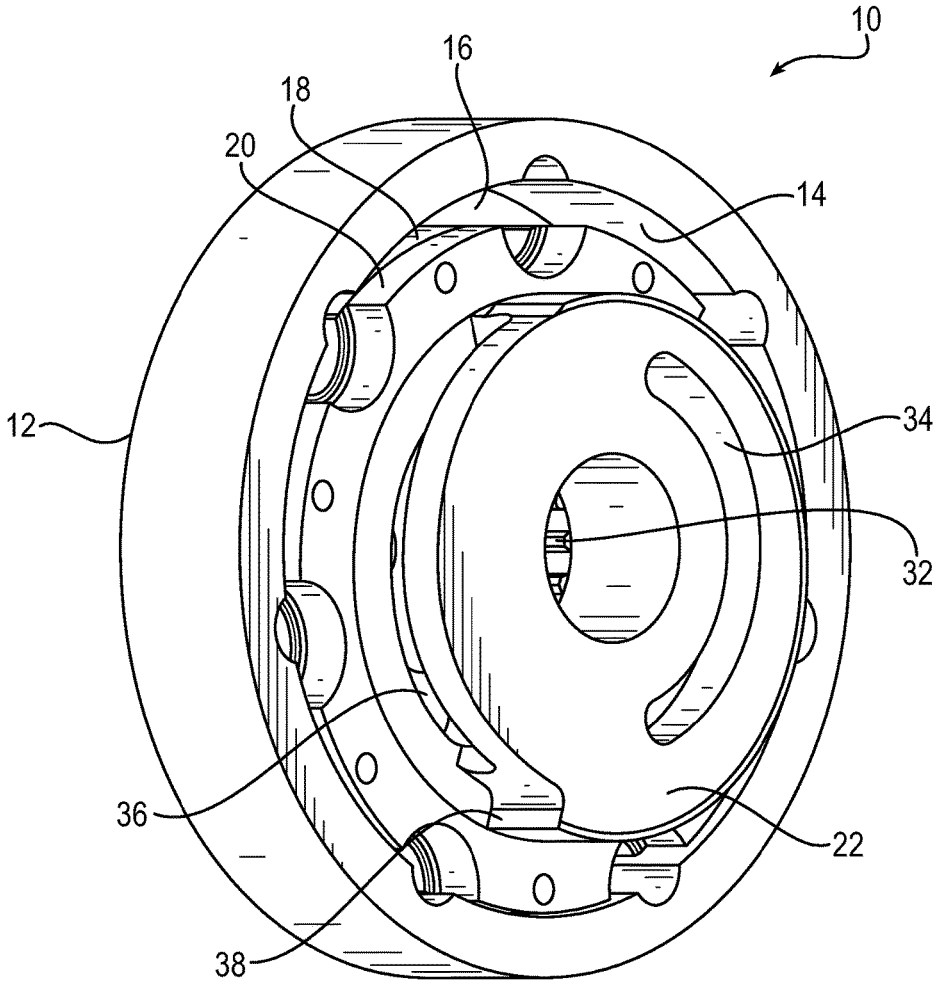
FIG. 1 is a drawing depicting an isometric view of an exemplary hydraulic motor with a commutator in a first rotational position, in accordance with embodiments of the present invention.

Embodiments of the present invention will now be described with reference to the drawings, wherein like reference numerals are used to refer to like elements throughout. It will be understood that the figures are not necessarily to scale.

Generally, an aspect of the invention is a hydraulic motor. In exemplary embodiments, the hydraulic motor includes a rotor and a stator, wherein the rotor and the stator define a plurality of motor pockets for receiving a flow of hydraulic fluid, and the rotor is configured to rotate relative to the stator based on a pressure differential between the motor pockets. A commutator having porting is configured to control the flow of hydraulic fluid into the motor pockets. The rotor is configured to rotate about a first axis and the stator is configured to rotate about a second axis, and the stator is configured to orbit such that the second axis orbits about the first axis. The commutator is eccentrically piloted about the first axis and the second axis so that the commutator both rotates and orbits to control the flow of hydraulic fluid into the motor pockets.

Figure 2:
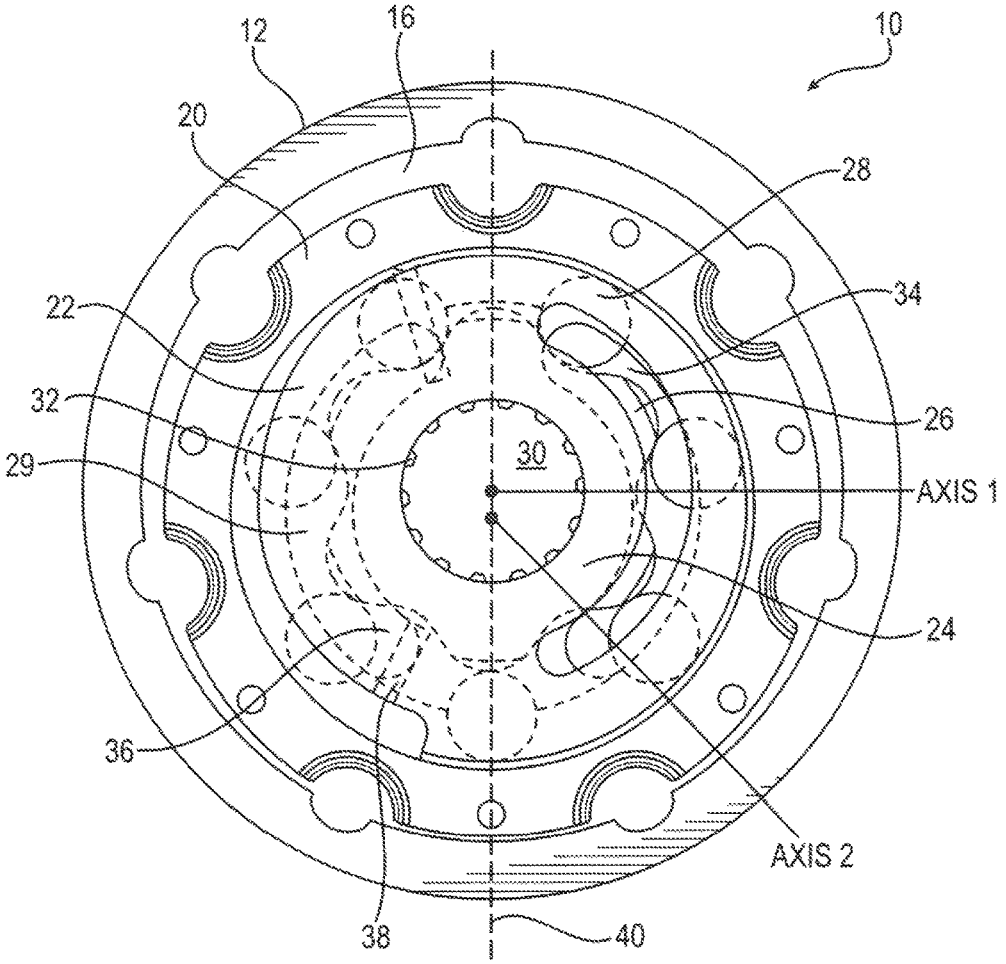
FIG. 2 is a drawing depicting a side cross-sectional view in a first plane of the exemplary hydraulic motor of FIG. 1.
Figure 3:
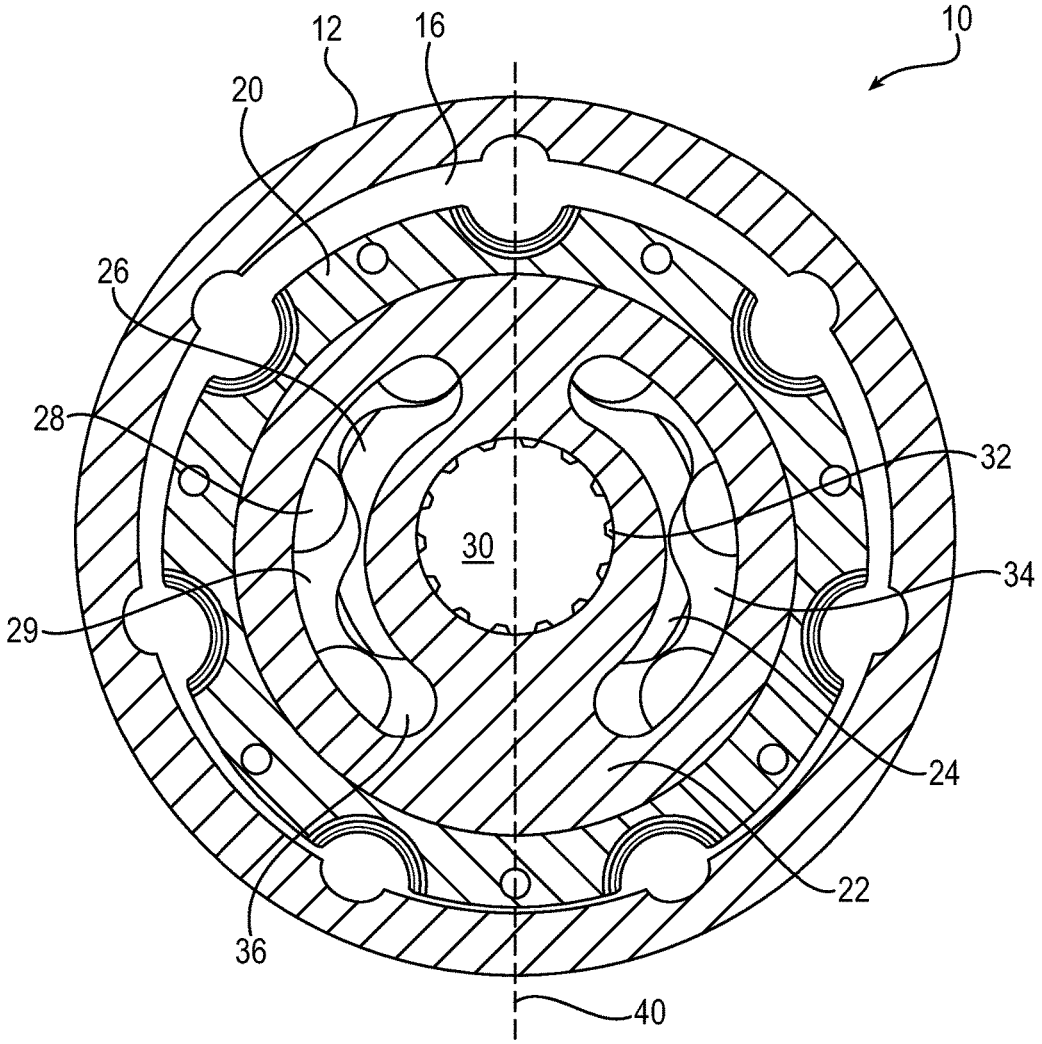
FIG. 3 is a drawing depicting a side cross-sectional view in a second plane of the exemplary hydraulic motor of FIG. 1.

FIG. 1 is a drawing depicting an isometric view of an exemplary hydraulic motor 10 in accordance with embodiments of the present invention. FIG. 2 is a drawing depicting a side cross-sectional view in a first plane of the exemplary hydraulic motor 10 of FIG. 1, and FIG. 3 is a drawing depicting a side cross-sectional view in a second plane of the exemplary hydraulic 10 motor of FIG. 1.

The hydraulic motor 10 includes an outer housing ring 12 having an inner diameter 14 that defines an orbiting space 16. The hydraulic motor 10 further includes, radially inward relative to the housing ring 12, an orbiting assembly comprising a stator 18 that is fixed in a longitudinal direction to an orbiting ring 20. The separate components of the stator 18 and orbiting ring 20 are most readily seen in the isometric view of FIG. 1, and the stator is behind the orbiting ring in the cross-sectional views of FIGS. 2 and 3. The orbiting assembly further includes a commutator 22 that is positioned radially inward relative to the orbiting ring 20, and as seen particularly in the isometric view of FIG. 1, the commutator 22 also extends longitudinally from the orbiting ring 20. Accordingly, the orbiting assembly includes the orbiting ring 20 that is longitudinally fixed to the stator 18 and radially fixed to the commutator 22, and a portion of the commutator extends longitudinally from the orbiting ring opposite to the stator.

The hydraulic motor 10 further includes a rotor 24 that is configured to rotate within the stator 18. The rotor is most readily seen in FIG. 3 as the section plane of FIG. 3 is nearer the rotor, and is also readily seen in FIG. 2. The rotor includes a plurality of lobes 26, and the stator includes a plurality of vanes 28, and as the rotor rotates, the lobes and vanes form successive windows or motor pockets 29 for the receipt and expulsion of hydraulic fluid. As the rotor rotates, expanding motor pockets permit entry of hydraulic fluid, while reducing motor pockets expel hydraulic fluid. Pressure differentials generated by such hydraulic fluid flow causes the rotor to continue to rotate, which drives an output element such as an output shaft. The output shaft is not specifically shown in FIGS. 1-3, but a shaft space 30 is defined by the motor components to permit extension of an output shaft through the motor to an external drive element. Splines 32 may be provided on an inner diameter of the rotor, which in operation would interact with cooperating splines on the output shaft. Having lobes 26 on the rotor and vanes 28 on the stator is similar in this respect to a conventional Ross motor as described above. Accordingly, the present invention can achieve a relatively large motor pocket size so as to provide substantial output power with relatively less flow rate, thereby reducing flow losses.

The porting defined by the commutator will now be described. In general, a rotational position of the commutator controls the flow of hydraulic fluid into the windows or motor pockets defined by the spaces between the lobes and vanes of the rotor and stator. Rotation of the commutator causes the ports to supply different motor pockets with hydraulic fluid in a progressive manner around the periphery of the rotor in such a way as to maintain a pressure differential between the correct motor pockets to maintain further rotation of the rotor. In addition, the commutator 22 is described in connection with its use with the hydraulic motor 10. It will be appreciated, however, that the commutator 22 may be employed in other hydraulic motors. For example, the commutator 22 may be employed in more conventional Ross and Nichols motors.

In exemplary embodiments, the commutator defines inner and outer commutator ports, which may be configured more particularly as an inner kidney port and an outer kidney port. The inner kidney port is associated with a first pressure of hydraulic fluid, and the outer kidney port is associated with a second pressure of hydraulic fluid, with one of the first or second pressures being a high pressure and the other being a low pressure to provide the pressure differential to maintain rotation of the rotor. For example, the first pressure may be a low pressure such that the inner kidney port may be a low pressure port, and the second pressure may be a high pressure such that the outer kidney port may be a high pressure port. With such configuration, an exemplary forward mode of operation is achieved, ultimately driving the rotor and in turn the output shaft in a forward direction. It will be appreciated that the high and low pressures may be reversed so as to drive the rotor and output shaft in the reverse direction. In addition, although the inner and outer commutator ports are configured as kidney ports in this example, other shaped, numbers, or configurations of ports may be achieved so long as there are a high pressure side port(s) and a low pressure side port(s).

Accordingly, the porting of the commutator includes an inner commutator port configured to supply hydraulic fluid to the motor pockets at a first pressure, and an outer commutator port configured to supply hydraulic fluid to the motor pockets at a second pressure different from the first pressure to create the pressure differential between the motor pockets. Referring to the figures, the commutator 22 defines an inner kidney port 34 and an outer kidney port 36. In an exemplary embodiment, the inner kidney port extends all the way through an entire longitudinal thickness of the commutator. With such configuration, hydraulic fluid at the first pressure can flow into the motor pockets directly through the entire longitudinal thickness of the commutator via the inner kidney port 34. In contrast, the outer kidney port 36 does not extend through the entirety of the longitudinal thickness of the commutator in this example configuration. Rather, the outer kidney port 36 is in fluid communication with the orbiting space 16, defined by the housing ring 12, via a slot 38 defined by the commutator that extends from the outer kidney port 36 through the outer diameter of the commutator.

The slot 38 is best seen in the isometric view of FIG. 1. The outer commutator port thus extends partially through the longitudinal thickness of the commutator, and the slot forms a fluid pathway between the outer commutator port and an outer diameter of the commutator. With such configuration, hydraulic fluid at the second pressure can flow into the motor pockets from the orbital space 16, through the slot 38 and outer kidney port 36, and into the motor pockets. In this manner, a high pressure side is achieved and a low pressure side is achieved, without interconnection of hydraulic fluid flow between the two sides. A fluid pathway through the inner commutator port is thereby isolated from a fluid pathway through the outer commutator port.

FIGS. 2 and 3, as referenced above, depict cross-sectional views in two different planes. The first plane depicted in FIG. 2 is relatively farther in the longitudinal direction from the rotor 24. In such plane, the inner kidney port 34 is viewable, as such port is cut through the entire longitudinal thickness of the commutator 22. However, the outer kidney port 36 is "ghosted" with a dashed line in this view, as such port does not extend through the commutator at the depicted plane. The second plane depicted in FIG. 3 is relatively closer in the longitudinal direction to the rotor 24. In such plane, both the inner kidney port 34 and outer kidney port 36 are viewable, as in such plane the ports provide the fluid flow into the motor pockets defined by the lobes 26 of the rotor 24 and the vanes 28 of the stator 18.

With such configuration, the inner and outer commutator ports supply fluid to the motor pockets, and they do so separately so as to divide the motor into sides of different pressures. For example, the outer kidney port may be associated with a high pressure side and the inner kidney port may be associated with a low pressure side. The high and low pressure sides are separated at a transition plane 40, indicated in FIGS. 2 and 3. The configuration of the commutator ports isolates the fluid flow into the high pressure and low pressure sides on opposite sides of the transition plane 40, so as to maintain the pressure differential for driving the continued rotation of the rotor.

The operation of the present invention is characterized by two axes of rotation, shown for example in FIG. 2. A first axis, Axis 1, is defined as the axis of rotation of the rotor, and a second axis, Axis 2, is defined as the central axis of the stator. As described above in the background section, in conventional Ross motors Axis 1 also is the axis of rotation of the drive link, and Axis 1 orbits about Axis 2. In conventional Nichols motors, Axis 1 also is the axis of rotation of the output shaft (there is no drive link), and Axis 2 orbits about Axis 1.

Figure 2A:
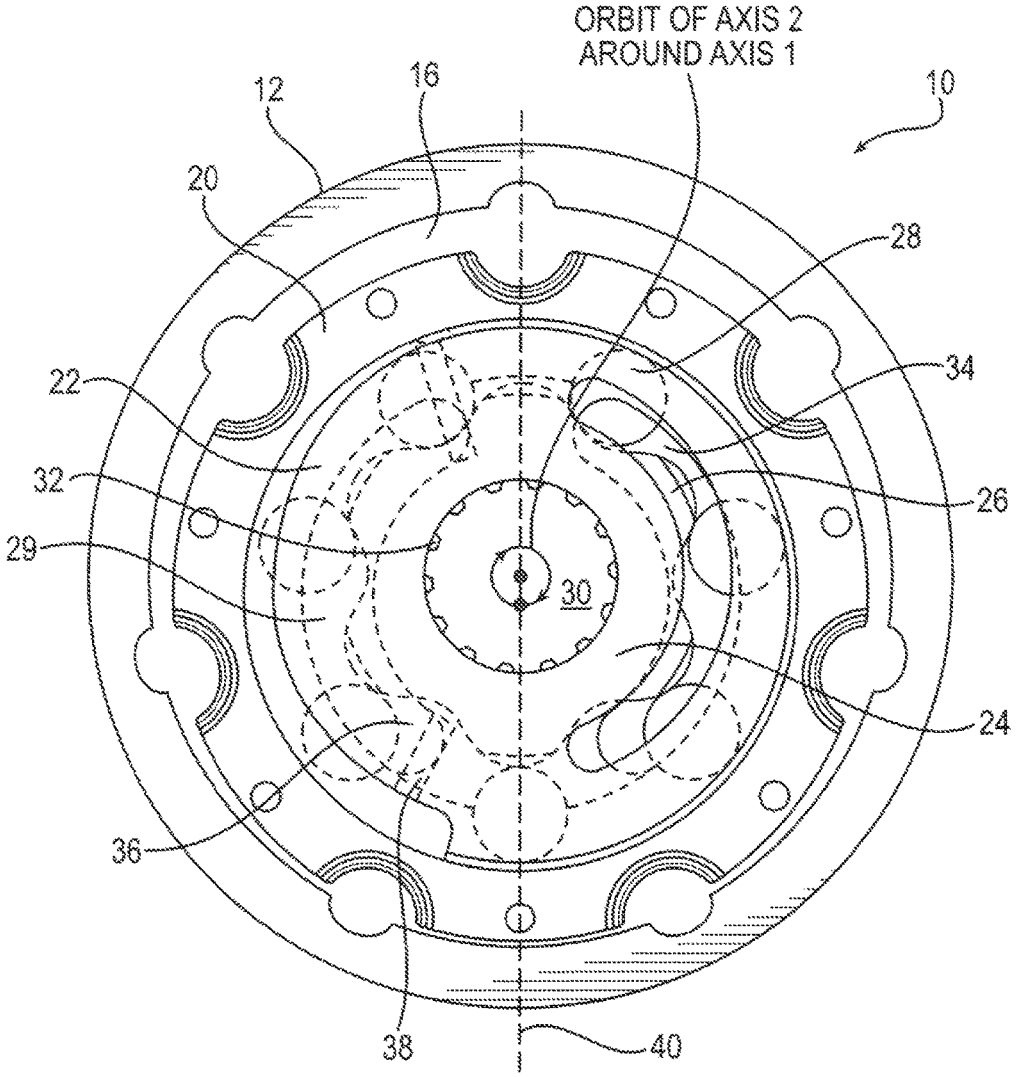
FIG. 2A is a drawing depicting the hydraulic motor of FIG. 2, showing the orbiting of Axis 2 around Axis 1.

To overcome the deficiencies of conventional motors, the commutator 22 is eccentrically piloted by piloting the commutator on both Axis 1 and Axis 2 by the pressure differential of the first and second pressure, with Axis 2 orbiting about Axis 1. The orbiting of Axis 2 about Axis 1 is shown in FIG. 2A. By piloting the commutator on both axes, the commutator 22 both rotates and orbits so as to maintain a proper fluid flow into the motor pockets. More specifically, Axis 1 constitutes the axis of rotation of the rotor 24, which also is the central axis of the housing ring 12. Axis 2 is the axis of rotation of the stator 18 and orbiting ring 20. The housing ring 12 acts as a locator ring for defining the orbiting of the stator/orbiting ring assembly, and thus Axis 2 orbits about Axis 1. The orbiting of Axis 2 around Axis 1 is relatively small so as to permit large motor pockets defined by the rotor and stator. The commutator orbits with the stator/orbiting ring assembly as well. The portion of the shaft space 30 through the commutator 22 is eccentrically positioned through the commutator, meaning that the shaft space 30 is off-center relative to the outer diameter of the commutator 22. The commutator is piloted on its inner diameter (defining the shaft space 30) by Axis 1, and is piloted on its outer diameter by Axis 2. As a result of the combination of piloting the commutator on both Axes 1 and 2, and the eccentric positioning of the shaft space 30 through the commutator, the resultant motion is a combined rotation and orbiting of the commutator 22 by which the shaft space 30 (and thus the output shaft) undergoes pure rotation about Axis 1.

Advantages of such configuration are as follows. The shaft space, and thus the output shaft, rotate about the first axis without orbiting, thereby eliminating the need for an additional drive link comparably as in the Nichols motor. In addition, the lobes are provided on the rotor and the vanes are provided on the stator comparably as in the Ross motor. The configuration disclosed herein further results in larger windows or motor pockets for the fluid flow, thereby reducing flow losses, comparably as the Ross motor configuration adapted with a drive link driven timing valve, but without using the additional drive links. The present invention, therefore, provides the advantages of the various conventional motor configurations, while avoiding the commensurate deficiencies of each of such conventional configuration. The need for a separate manifold for fluid ports also is eliminated, as the porting in the commutator is sufficient for defining the fluid pathways. The absence of a separate manifold component also enables larger flow areas so as to reduce flow losses. Furthermore, the rotation and orbiting of the commutator regulates the position of the transition plane that separates the high and low pressure sides, rather than controlling the flow into the motor pockets on a more individualized basis as done in conventional configurations. This also results in higher motor efficiency by reducing flow losses.

Figure 4:
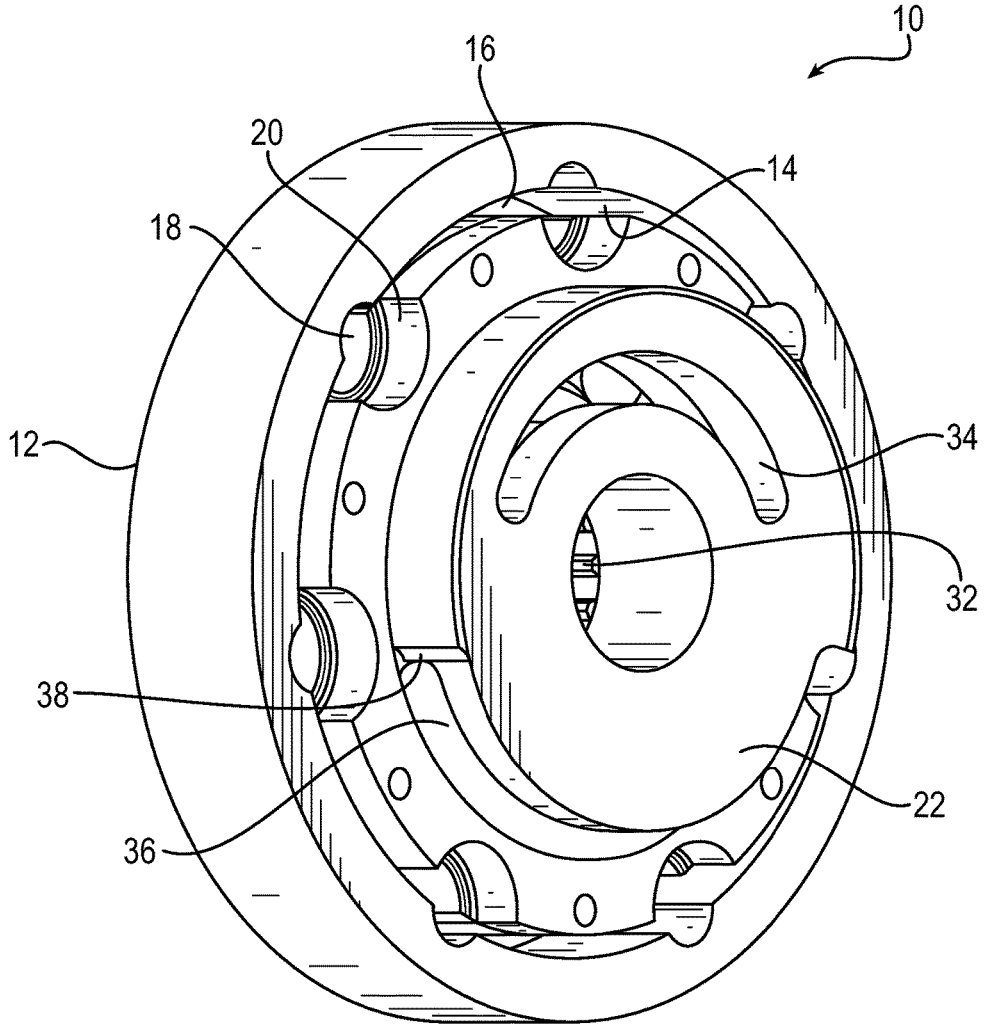
FIG. 4 is a drawing depicting an isometric view of the exemplary hydraulic motor of FIG. 1 with the commutator in a second rotational position, in accordance with embodiments of the present invention.
Figure 5:
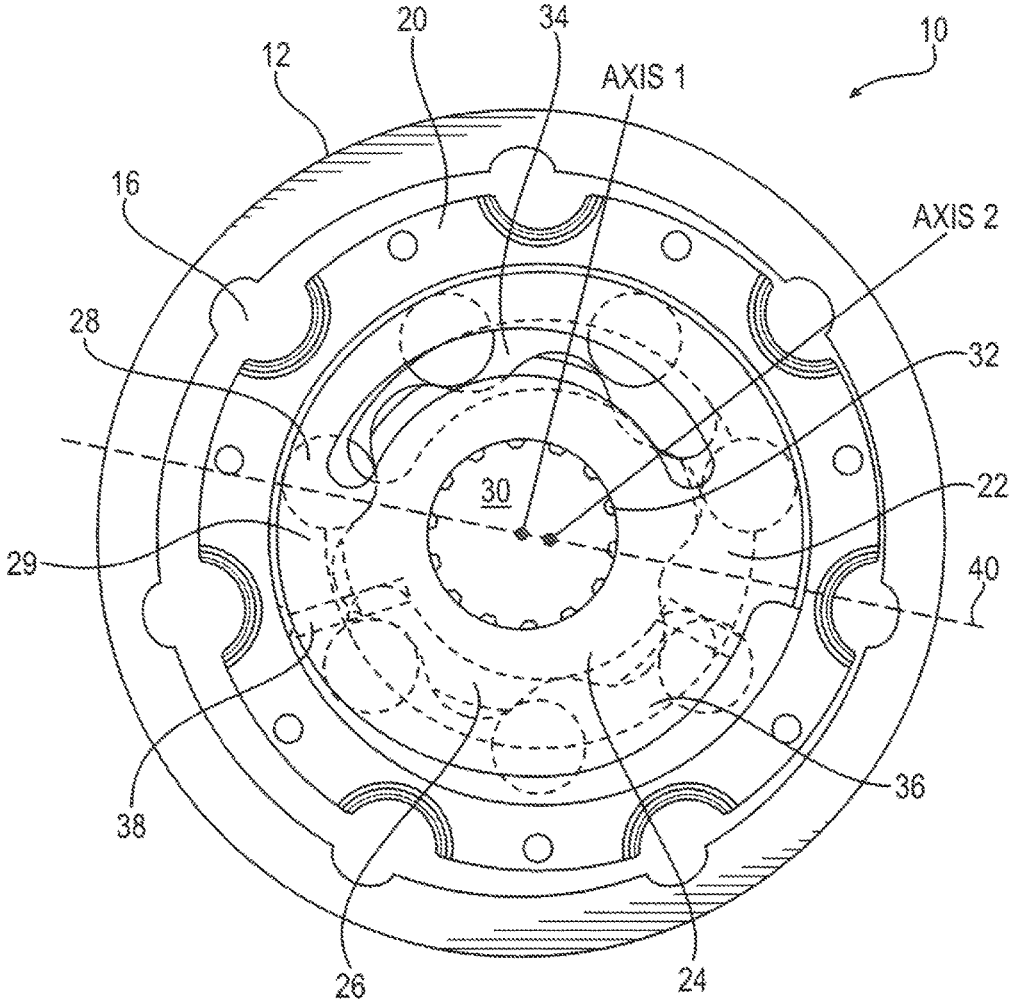
FIG. 5 is a drawing depicting a side cross-sectional view in a first plane of the exemplary hydraulic motor of FIG. 4.
Figure 6:
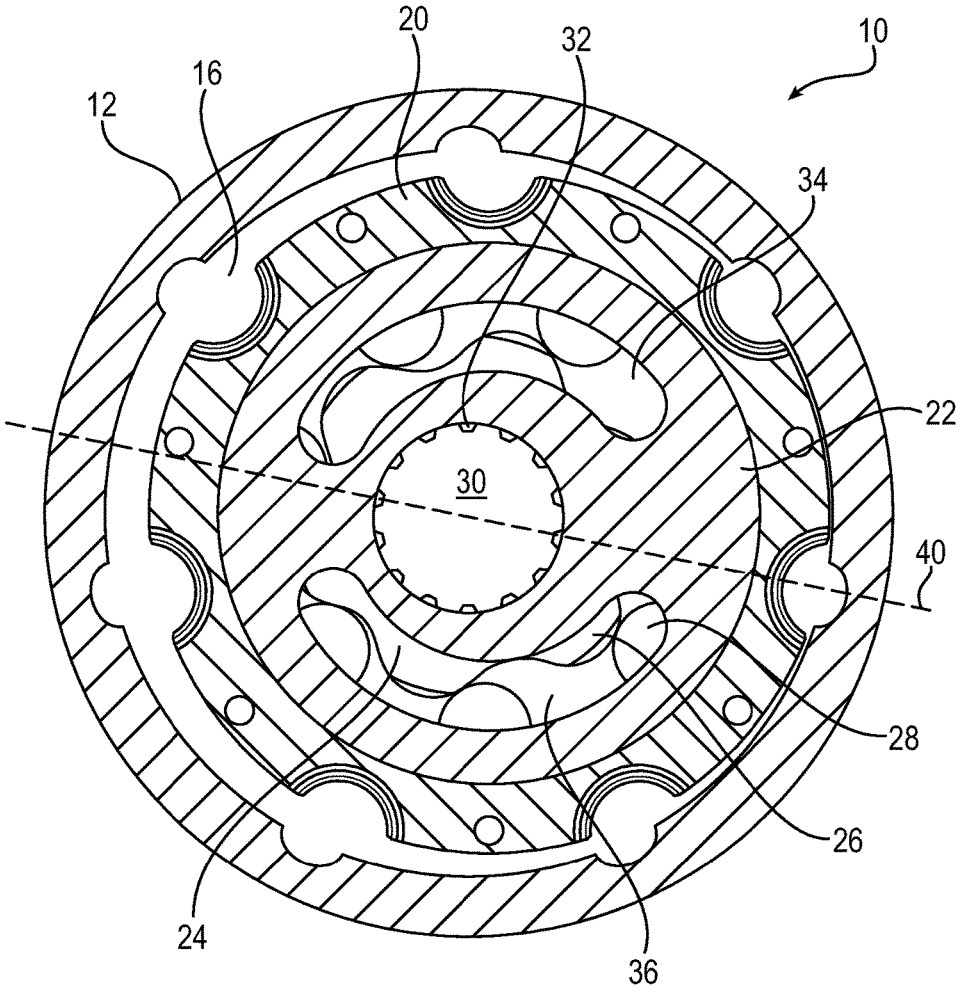
FIG. 6 is a drawing depicting a side cross-sectional view in a second plane of the exemplary hydraulic motor of FIG. 4.
Figure 7:
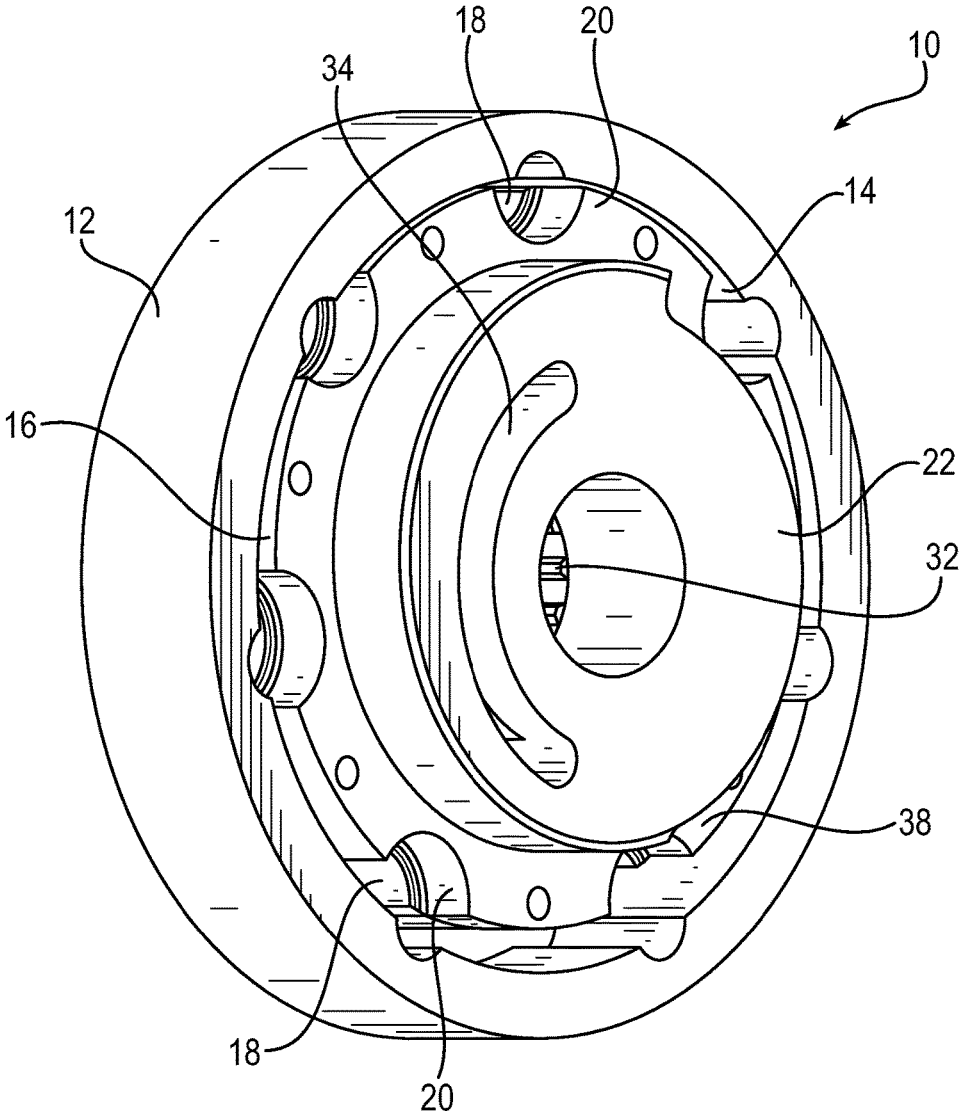
FIG. 7 is a drawing depicting an isometric view of the exemplary hydraulic motor of FIG. 1 with the commutator in a third rotational position, in accordance with embodiments of the present invention.
Figure 8:
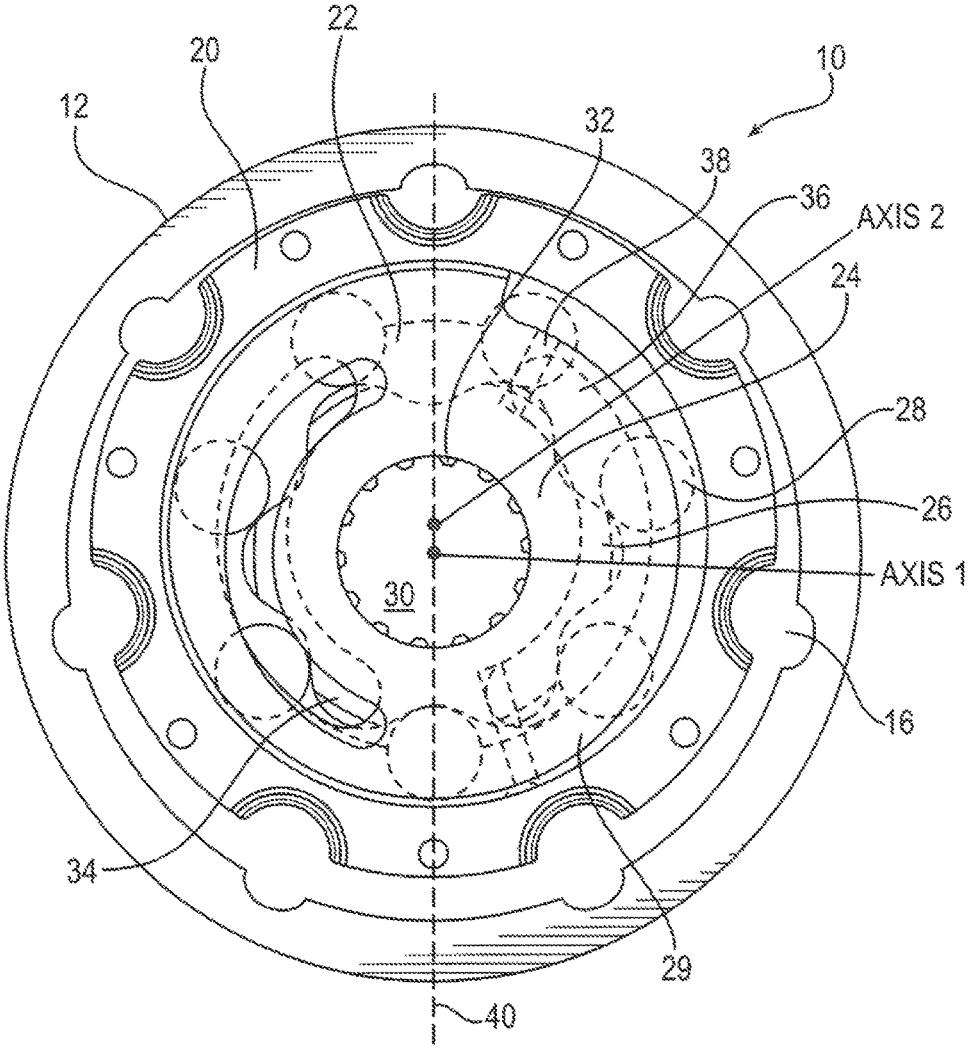
FIG. 8 is a drawing depicting a side cross-sectional view in a first plane of the exemplary hydraulic motor of FIG. 7.
Figure 9:
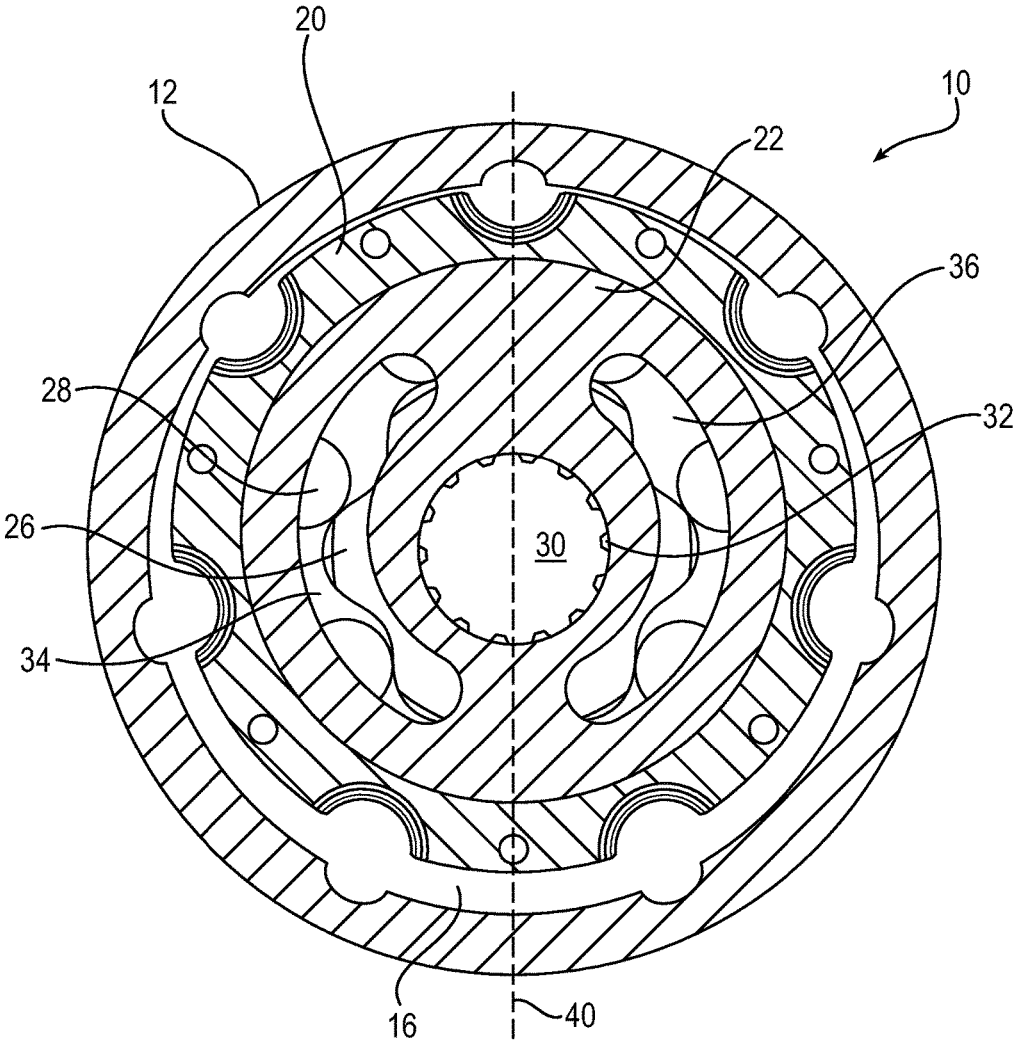
FIG. 9 is a drawing depicting a side cross-sectional view in a second plane of the exemplary hydraulic motor of FIG. 7.

FIGS. 4-6 are drawings depicting the exemplary hydraulic motor 10, which are comparable to FIGS. 1-3 except that FIGS. 4-6 depict the commutator in a second rotational position rotated counterclockwise relative to a first rotational position in the depiction in FIGS. 1-3. Similarly, FIGS. 7-9 are drawings depicting the exemplary hydraulic motor 10, which are comparable to FIGS. 1-3 except that FIGS. 7-9 depict the commutator in a third rotational position. The rotational position of FIGS. 7-9 illustrates essentially a 180° rotation relative to the first rotational position of FIGS. 1-3, with the second rotation of FIGS. 4-6 being an intermediate rotational position between those of FIGS. 1-3 and 7-9. Accordingly, like reference numerals are used for common features of FIGS. 1-9.

The progression of rotational positions in the figures is characterized in the rotation of the transitional plane 40 dividing the motor into the first (e.g. high) and second (e.g., low) pressure sides. This is shown particularly in FIGS. 2-3, 5-6, and 8-9 showing the cross-sectional line corresponding to the rotational plane 40. The inner kidney port 34 and outer kidney port 36 of the commutator are shown being in three rotational positions, thereby being configured to supply different motor pockets with fluid to drive the rotor. As referenced above, in this manner the rotational position of the commutator controls the flow of hydraulic fluid into the windows or motor pockets defined by the spaces between the lobes and vanes of the rotor and stator. Rotation of the commutator causes the inner and outer commutator ports to supply different pockets with hydraulic fluid in a progressive manner around the periphery of the rotor, in such a way as to maintain a pressure differential between the correct pockets to maintain continued rotation of the rotor.

The first (FIGS. 1-3), second (FIGS. 4-6), and the third (FIGS. 7-9) rotational positions also show the orbital progression of the orbital assembly including the stator 18, orbital ring 20, and commutator 22. The orbital assembly orbits within the orbital space 16 defined by the inner diameter 14 of the housing ring 12. For example, in the cross-sectional view of FIG. 2 corresponding to the first rotational position, an outer diameter of the stator/orbiting ring assembly is essentially adjacent to a lower portion of the inner diameter of the housing ring in the drawing. In the cross-sectional view of FIG. 5 corresponding to the second rotational position, an outer diameter of the stator/orbiting ring assembly is essentially adjacent to a right side portion of the inner diameter of the housing ring in the drawing. In the cross-sectional view of FIG. 8 corresponding to the third rotational position, an outer diameter of the stator/orbiting ring assembly is essentially adjacent to an upper portion of the inner diameter of the housing ring in the drawing. With the eccentric positioning of the shaft space 30 through the commutator 22, the resultant motion is a combined rotation and orbiting of the commutator 22 by which the shaft space 30 (and thus the output shaft when present) rotates about the same axis of rotation of the rotor, thereby eliminating the need for the additional drive link as described above.

Figure 10:
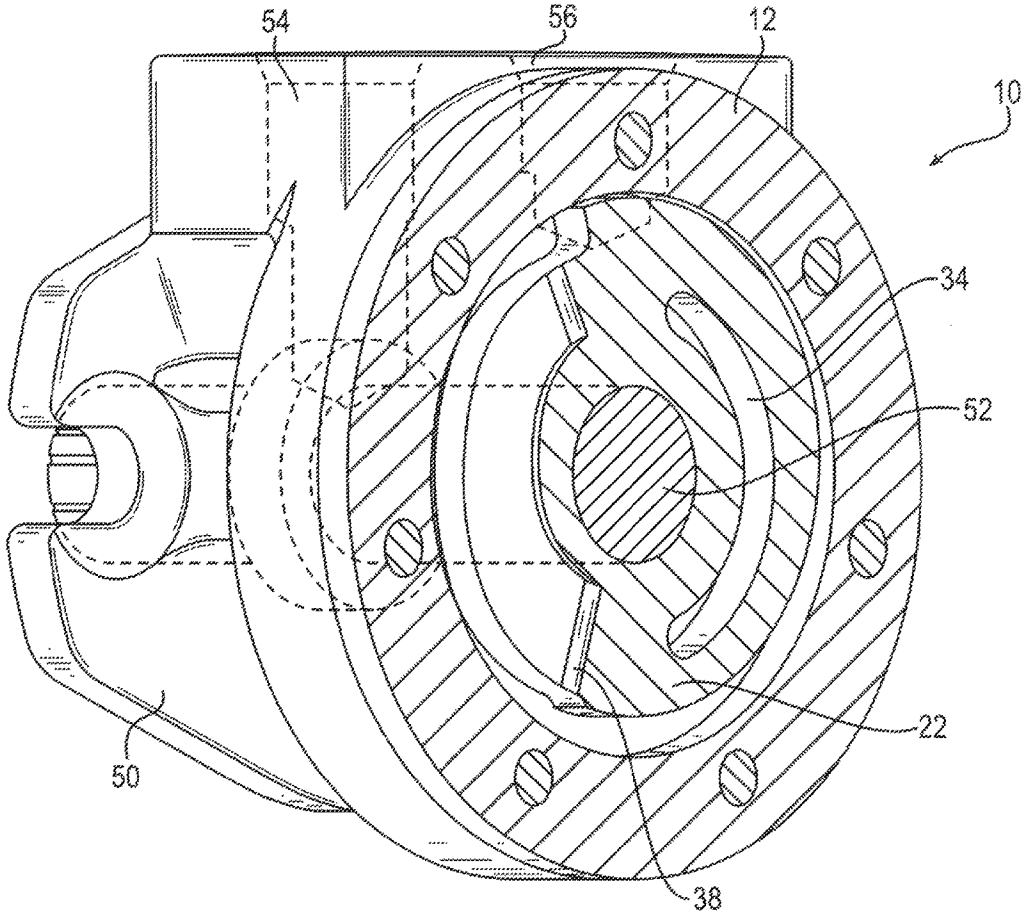
FIG. 10 is a drawing depicting an isometric view of pressure input components of the exemplary hydraulic motor, with the commutator in the first rotational position, in accordance with embodiments of the present invention.
Figure 11:
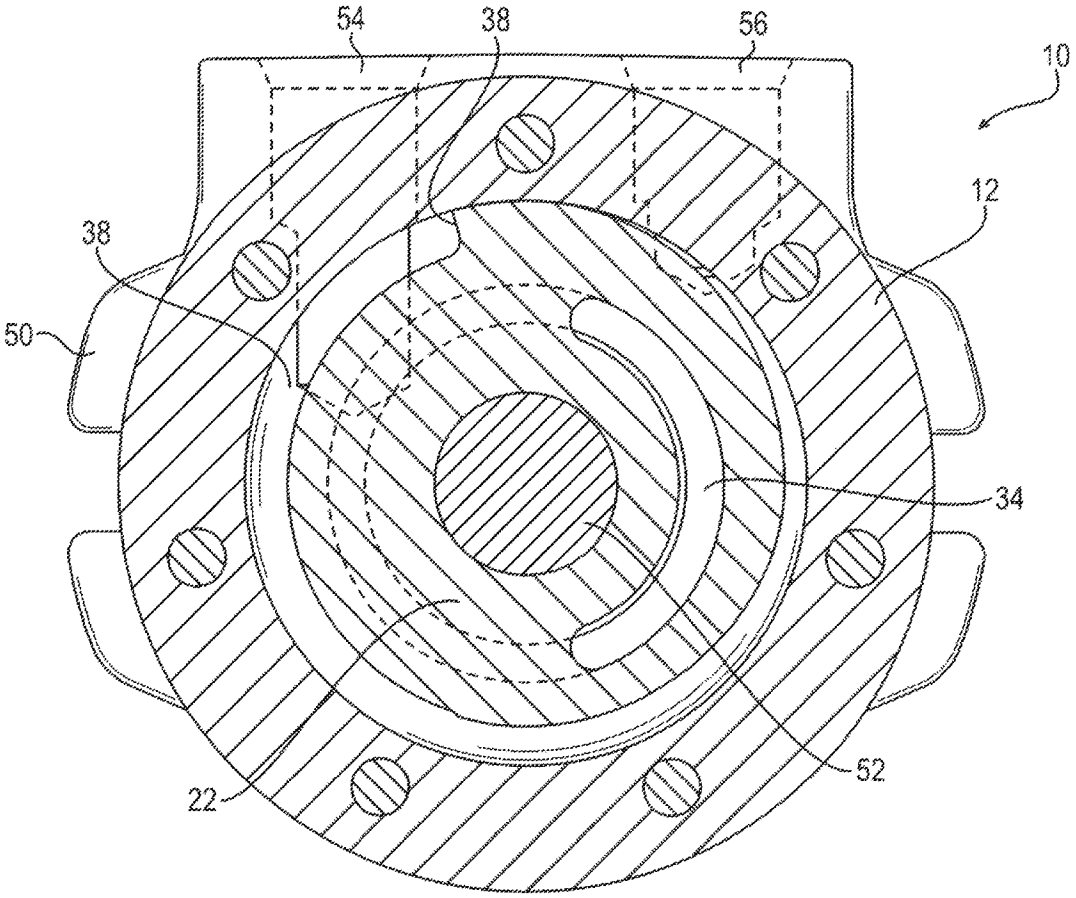
FIG. 11 is a drawing depicting a side cross-sectional view in a first plane of the exemplary pressure input features of FIG. 11 of the hydraulic motor.
Figure 12:
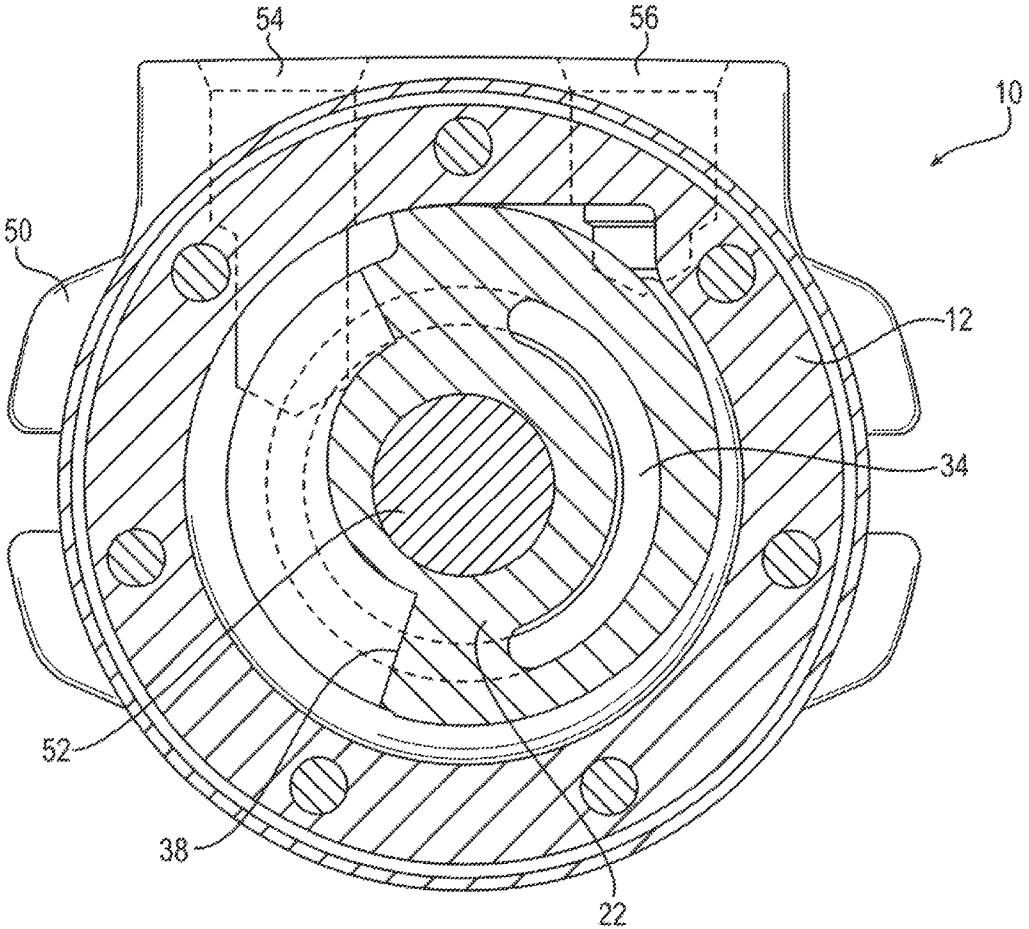
FIG. 12 is a drawing depicting a side cross-sectional view in a second plane of the exemplary pressure input features of FIG. 11 of the hydraulic motor.

FIGS. 10-12 depict the pressure input components of the hydraulic motor 10. In particular, FIG. 10 is a drawing depicting an isometric view of pressure input components of the exemplary hydraulic motor 10, with the commutator 22 being in the first rotational position, in accordance with embodiments of the present invention. FIG. 11 is a drawing depicting a side cross-sectional view in a first plane of the exemplary pressure input features of FIG. 11 of the hydraulic motor. FIG. 12 is a drawing depicting a side cross-sectional view in a second plane of the exemplary pressure input features of FIG. 11 of the hydraulic motor.

The views of FIGS. 10-12 are sectioned in planes that are on the fluid input side of the motor upstream relative to the orbital ring, stator, and rotor. The orbital ring, stator, and rotor, therefore, are removed in FIGS. 10-12 relative to FIGS. 1-9 because such components essentially would be located "out of page" relative to the section planes in FIGS. 10-12. As seen in FIGS. 10-12, the hydraulic motor 10 includes a main motor housing 50 that constitutes a primary support housing for the various components of the motor. An output shaft 52 (not seen in FIGS. 1-9) extends though the motor components, from a first end that is located outside of the motor housing 50 through the ring and commutator components. Referring to FIGS. 1-9, the output shaft 52 would extend though the shaft space 30 defined by the other motor components. FIGS. 10-12 also depict the housing ring 12 from FIGS. 1-9, which is fixed to the main motor housing 50.

The hydraulic motor 10 includes a first pressure inlet 54 and a second pressure inlet 56 that extend through the motor housing 50. The pressure inlets supply the pressurized hydraulic fluid to drive the combined rotation and orbiting motion of the commutator as described above, and in turn causing rotation of the rotor and orbiting of the orbiting ring/stator assembly. For example, the first pressure inlet 54 may supply the hydraulic fluid at the first pressure referenced above, and the second pressure inlet 56 may supply the hydraulic fluid at the second pressure referenced above. As seen particularly in FIGS. 11 and 12, in exemplary embodiments the first pressure inlet 54 is in fluid communication with the inner commutator kidney port 34, and the second pressure inlet 56 is in fluid communication with the outer commutator kidney port 36. In the particular plane section as taken in FIGS. 10-12, the slot 38 is open to the orbiting space 16 so as to provide a fluid pathway into the outer kidney port. Again, the first pressure may be a low pressure such that the inner kidney port may be a low pressure port, and the second pressure may be a high pressure such that the outer kidney port may be a high pressure port. With such configuration, an exemplary forward mode of operation is achieved, ultimately driving the rotor and in turn the output shaft in a forward direction. It will be appreciated again that the high and low pressures may be reversed so as to drive the rotor and output shaft in the reverse direction.

Figure 13:
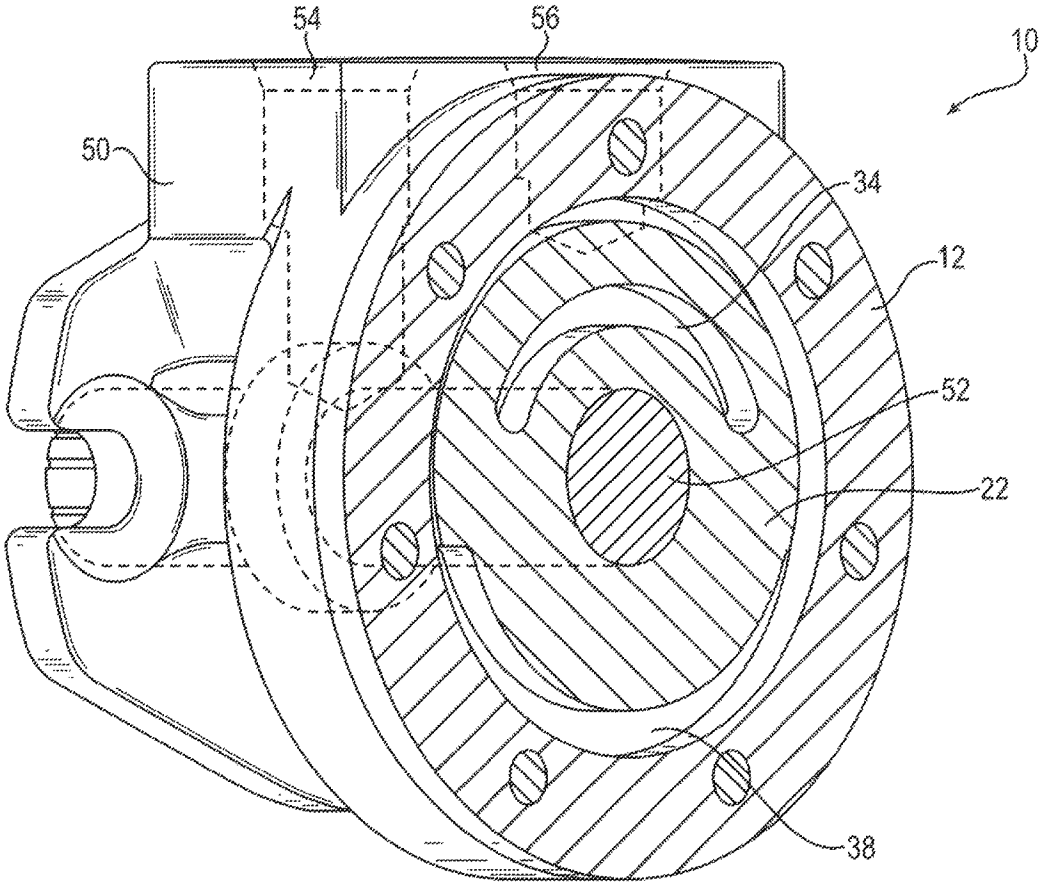
FIG. 13 is a drawing depicting an isometric view of pressure input components of the exemplary hydraulic motor, with the commutator in the second rotational position, in accordance with embodiments of the present invention.
Figure 14:
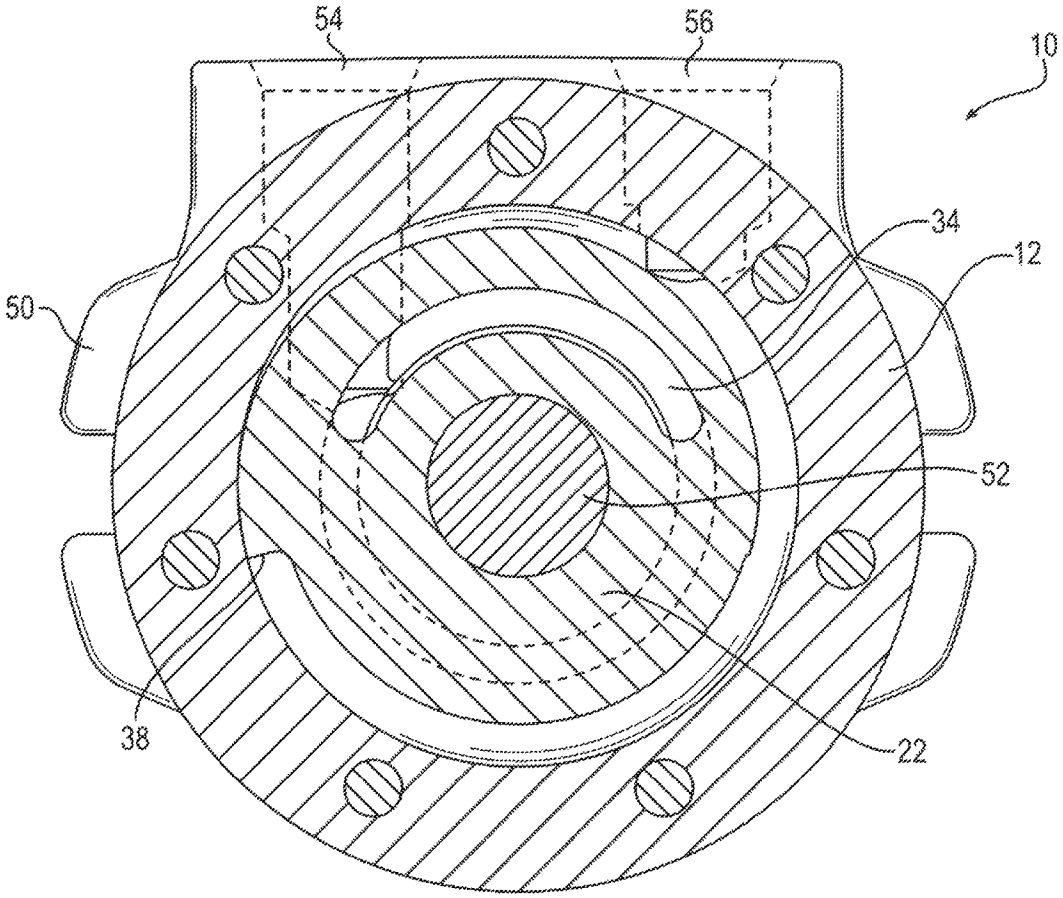
FIG. 14 is a drawing depicting a side cross-sectional view in a first plane of the exemplary pressure input features of FIG. 13 of the hydraulic motor.
Figure 15:
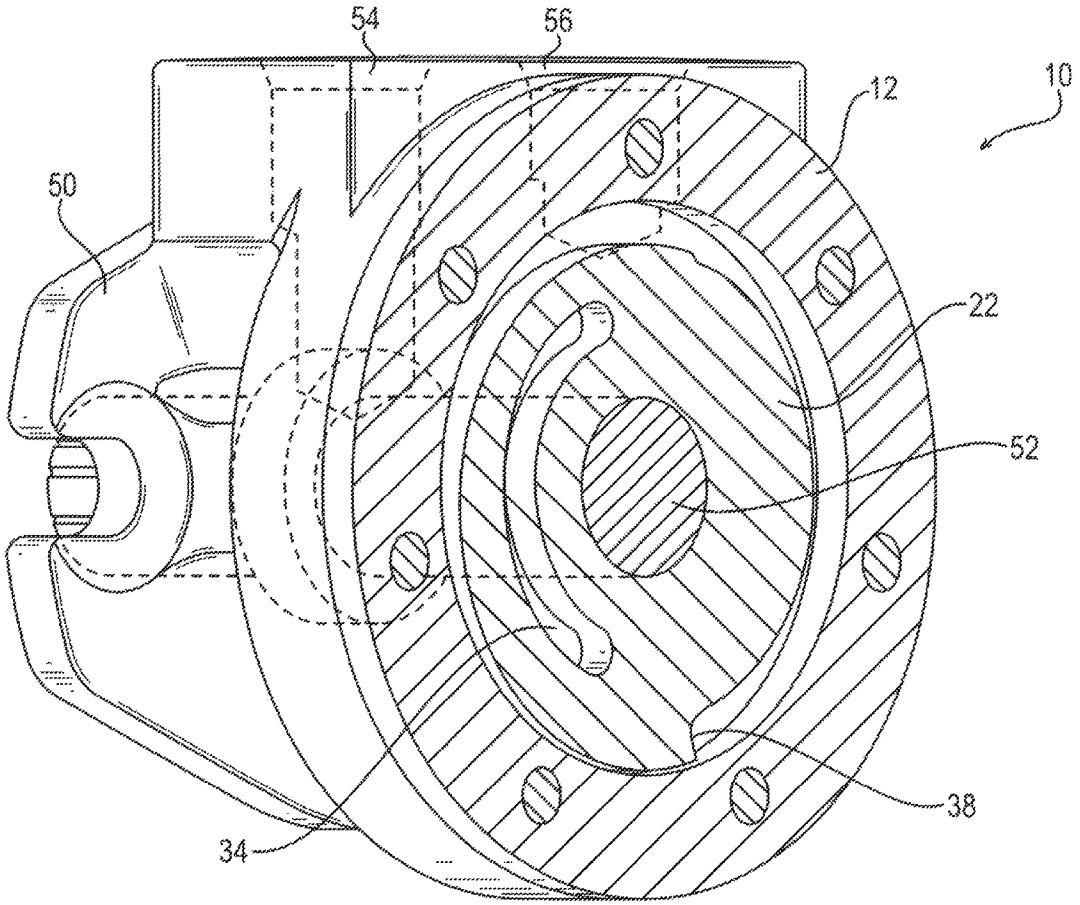
FIG. 15 is a drawing depicting an isometric view of pressure input components of the exemplary hydraulic motor, with the commutator in the third rotational position, in accordance with embodiments of the present invention.
Figure 16:
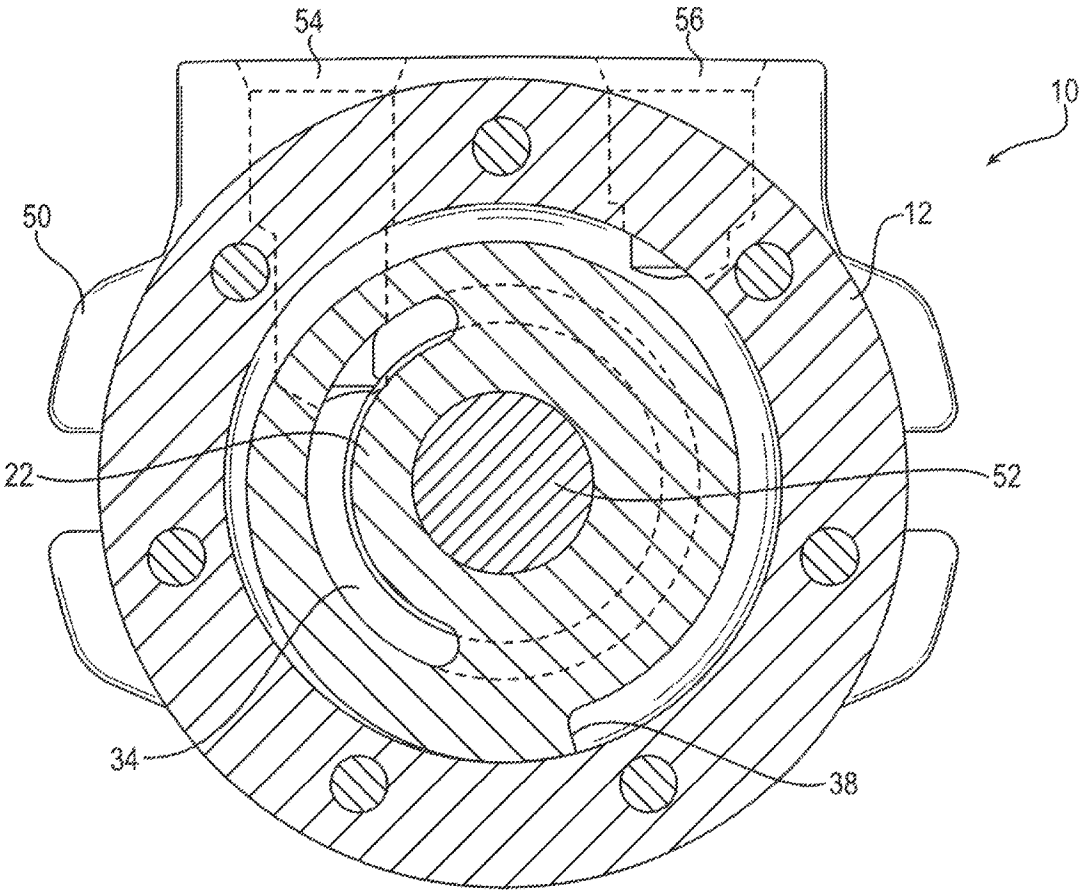
FIG. 16 is a drawing depicting a side cross-sectional view in a first plane of the exemplary pressure input features of FIG. 15 of the hydraulic motor.

Additional views of the pressure input features of the hydraulic motor 10 are depicted in FIGS. 13-16. FIGS. 10-12 depict the hydraulic motor components with the commutator in the first rotational position comparably as depicted in FIGS. 1-3. FIGS. 13-14 are drawings depicting the hydraulic motor components in the second rotational position comparably as in FIGS. 4-6. Such second rotational position as before depicts the commutator rotated counter-clockwise relative to the first rotational position in the depiction in FIGS. 1-3. With such rotation, the first pressure inlet 54 has maintained the fluid communication with the inner kidney port 34 of the commutator. In addition, the second pressure inlet 56 has maintained fluid communication with the orbital space 16 for fluid communication with the outer kidney port 36 of the commutator. FIGS. 15-16 are drawings depicting the hydraulic motor components in the third rotational position comparably as in FIGS. 7-9. Such third rotational position as before depicts the commutator rotated about 180° relative to the first rotational position in the depiction in FIGS. 1-3. Throughout the full rotation, the first pressure inlet 54 maintains the fluid communication with the inner kidney port 34 of the commutator. In addition, the second pressure inlet 56 maintains fluid communication with the orbital space 16 for fluid communication with the outer kidney port 36 of the commutator.

Recall that the inner kidney port 34 of the commutator in this example configuration extends all the way through the longitudinal thickness of the commutator, while the outer kidney port 36 of the commutator does not extend all the way through the longitudinal thickness of the commutator, so as to divide the commutator into the separated high pressure and low pressure sides. Accordingly, in the particular sectioning of FIGS. 13-14, and likewise in FIGS. 15-16, the outer kidney port is not actually visible as such port is not as yet present or opened up in such plane of the commutator. For illustrating the relative location, the outer kidney port 36 is shown hashed in the sectional views of FIGS. 14 and 16.

In contrast, FIGS. 10-12 are sectioned at a plane downstream relative to the plane of the sectioning in FIGS. 13-16. Accordingly, FIGS. 10-12 depict the commutator 22 in a plane where the slot 38 is formed, which provides the fluid pathway from the orbital space 16 to the outer kidney port 36 of the commutator. As the first kidney port 34 extends all the way through the longitudinal thickness of the commutator, the first kidney port 34 is comparably visible in all of FIGS. 10-16.

Figure 17:
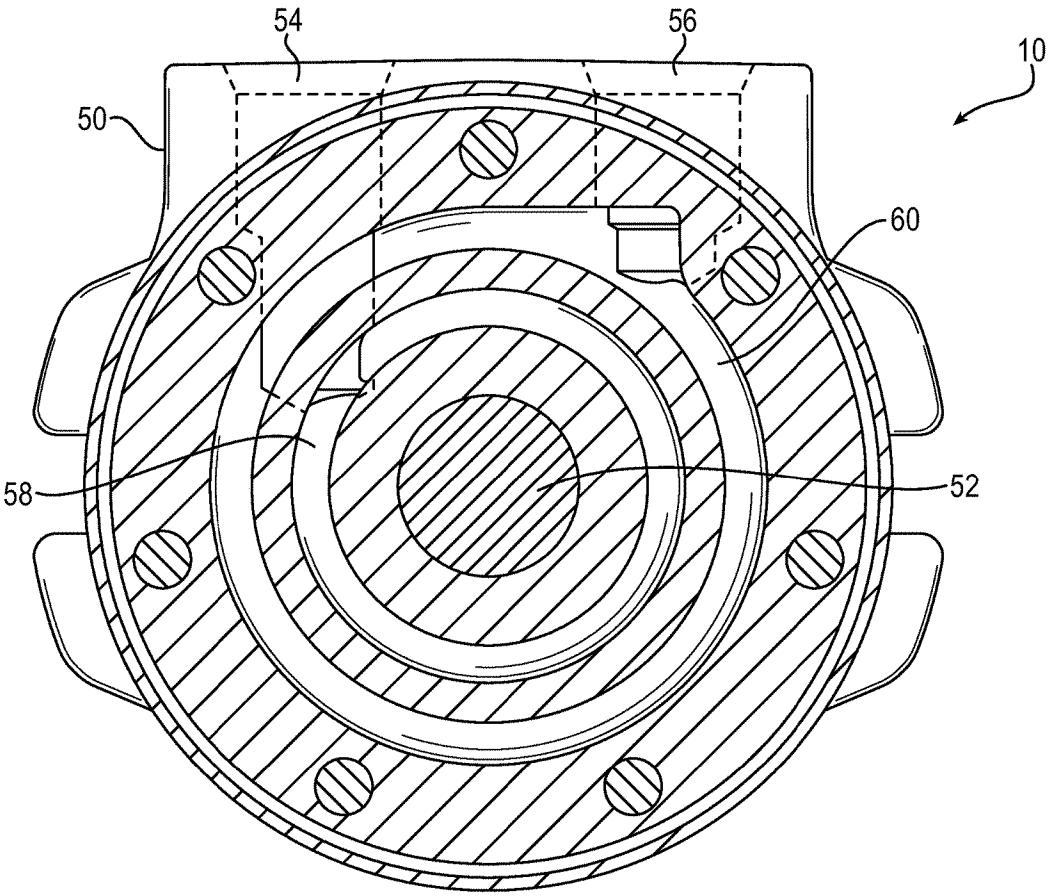
FIG. 17 is a drawing depicting a side cross-sectional view in a second plane of the exemplary pressure input features of FIG. 15 of the hydraulic motor.

FIG. 17 is a drawing depicting a side cross-sectional view showing additional details of the exemplary pressure input features of the hydraulic motor 10. FIG. 17 is sectioned in a plane upstream relative to housing ring, and so the housing ring is removed from FIG. 17 as the housing ring would be located "out of page" relative to the section plane of FIG. 17. Similarly, FIGS. 15 and 16 include the commutator 22, but the commutator 22 also is removed from FIG. 17 as the commutator likewise would be located "out of page" relative to the section plane of FIG. 17.

FIG. 17 thus shows the fluid porting within the main housing 50 upstream of the commutator. The motor housing defines and inner ring port 58 and an outer ring port 60. The inner ring port 58 has such ring configuration so as to remain in fluid communication with the inner kidney port 34 as the commutator 22 rotates and orbits in the manner described above. Similarly, the outer ring port 60 has such ring configuration so as to remain in fluid communication with orbital space 16 for fluid communication with the outer kidney port 36 as the commutator 22 rotates and orbits in the manner described above. The first (e.g., low) and second (e.g., high) pressure sides thus are separated by the cooperative porting through the motor housing and the commutator. In this manner, rotation and orbiting of the commutator causes the inner and outer commutator ports to supply different motor pockets with hydraulic fluid in a progressive manner around the periphery of the rotor, in such a way as to maintain a pressure differential between the correct pockets to maintain continued rotation of the rotor.

The present invention, therefore, has a configuration in which the commutator both rotates and orbits, being eccentrically piloted by piloting on both Axis 1 and Axis 2 as detailed above. As a result, the rotor and the output shaft rotate without orbiting, thereby eliminating the need for an additional drive link. The configuration also permits larger windows or motor pockets for the hydraulic fluid flow, thereby reducing flow losses. The present invention, therefore, provides the advantages of the various conventional motors, while avoiding the commensurate deficiencies of each of such conventional configurations. The result is a hydraulic motor with enhanced power output with reduced flow losses as compared to convention hydraulic motor configurations.

An aspect of the invention, therefore, is a hydraulic motor. In exemplary embodiments, the hydraulic motor includes a rotor and a stator, wherein the rotor and the stator define a plurality of motor pockets for receiving a flow of hydraulic fluid, and the rotor is configured to rotate relative to the stator based on a pressure differential between the motor pockets. The hydraulic motor further includes a commutator having porting configured to control the flow of hydraulic fluid into the motor pockets. The rotor is configured to rotate about a first axis and the stator is configured to rotate about a second axis, and the stator is configured to orbit such that the second axis orbits about the first axis. The commutator is eccentrically piloted about the first axis and the second axis so that the commutator both rotates and orbits to control the flow of hydraulic fluid into the motor pockets. The hydraulic motor may include one or more of the following features, either individually or in combination.

In an exemplary embodiment of the hydraulic motor, the hydraulic motor further includes an orbiting ring that is longitudinally fixed to the stator and radially fixed to the commutator, and a portion of the commutator extends longitudinally from the orbiting ring opposite to the stator.

In an exemplary embodiment of the hydraulic motor, the hydraulic motor further includes an outer housing ring. The stator, orbiting ring, and commutator comprise an orbiting assembly, and the housing ring defines an orbiting space in which the orbiting assembly orbits about the first axis.

In an exemplary embodiment of the hydraulic motor, the rotor has a plurality of lobes and the stator has a plurality of vanes, and as the rotor rotates the lobes and vanes successively form the motor pockets for receipt and expulsion of the hydraulic fluid.

In an exemplary embodiment of the hydraulic motor, the porting of the commutator comprises an inner commutator port configured to supply hydraulic fluid to the motor pockets at a first pressure, and an outer commutator port configured to supply hydraulic fluid to the motor pockets at a second pressure different from the first pressure to create the pressure differential between the motor pockets.

In an exemplary embodiment of the hydraulic motor, a fluid pathway through the inner commutator port is isolated from a fluid pathway through the outer commutator port.

In an exemplary embodiment of the hydraulic motor, the inner and outer commutator ports are shaped as kidney ports.

In an exemplary embodiment of the hydraulic motor, the inner commutator port extends through an entire longitudinal thickness of the commutator.

In an exemplary embodiment of the hydraulic motor, the outer commutator port extends partially through the longitudinal thickness of the commutator, and the commutator has a slot that forms a fluid pathway between the outer commutator port and an outer diameter of the commutator.

In an exemplary embodiment of the hydraulic motor, the hydraulic motor further includes an orbiting ring that is longitudinally fixed to the stator and radially fixed to the commutator, and a portion of the commutator extends longitudinally from the orbiting ring opposite to the stator, and an outer housing ring. The stator, orbiting ring, and commutator comprise an orbiting assembly, and the housing ring defines an orbiting space in which the orbiting assembly orbits about the first axis. The slot forms a fluid pathway between the outer commutator port and the orbiting space.

In an exemplary embodiment of the hydraulic motor, the commutator further defines a shaft space configured to receive an output shaft, and the shaft space is eccentrically positioned through the commutator.

In an exemplary embodiment of the hydraulic motor, the commutator is configured to be piloted on an inner diameter by the first axis, and to be piloted on its outer diameter by the second axis.

In an exemplary embodiment of the hydraulic motor, the hydraulic motor further includes a motor housing defining a first inlet configured to supply hydraulic fluid at the first pressure to the inner commutator port, and defining a second inlet configured to supply hydraulic fluid at the second pressure to the outer commutator port.

In an exemplary embodiment of the hydraulic motor, the first inlet includes an inner ring port in fluid communication with the inner commutator port, and the second inlet includes an outer ring port in fluid communication with the outer commutator port.

In an exemplary embodiment of the hydraulic motor, when the first pressure is a low pressure relative to the second pressure, the rotor is configured to rotate in a forward direction, and when the first pressure is a high pressure relative to the second pressure, the rotor is configured to rotate in a reverse direction.

In an exemplary embodiment of the hydraulic motor, the hydraulic motor further includes an output shaft that is configured to be driven by the rotation of the rotor.

In an exemplary embodiment of the hydraulic motor, the output shaft is configured to be driven by the rotation of the rotor to rotate about the first axis without orbiting.

Another aspect of the invention is a commutator configured to control a flow of hydraulic fluid through a hydraulic motor. In exemplary embodiments, the commutator includes porting configured to control the flow of hydraulic fluid, wherein the commutator is eccentrically piloted about a first axis and a second axis different from the first axis so that the commutator both rotates and orbits to control the flow of hydraulic fluid.

In an exemplary embodiment of the commutator, the porting comprises an inner commutator port configured to supply hydraulic fluid to motor pockets of the hydraulic motor at a first pressure, and an outer commutator port configured to supply hydraulic fluid to the motor pockets at a second pressure different from the first pressure to create the pressure differential between the motor pockets.

In an exemplary embodiment of the commutator, a fluid pathway through the inner commutator port is isolated from a fluid pathway through the outer commutator port.

In an exemplary embodiment of the commutator, the inner and outer commutator ports are shaped as kidney ports.

In an exemplary embodiment of the commutator, the inner commutator port extends through an entire longitudinal thickness of the commutator.

In an exemplary embodiment of the commutator, the outer commutator port extends partially through the longitudinal thickness of the commutator, and the commutator has a slot that forms a fluid pathway between the outer commutator port and an outer diameter of the commutator.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hydraulic motor comprising:

a rotor that is connected to a shaft that rotates about a first axis;

a stator having a central axis that is a second axis different from the first axis, wherein the rotor and the stator define a plurality of motor pockets for receiving a flow of hydraulic fluid, and the rotor is configured to rotate relative to the stator based on a pressure differential between the motor pockets; and a commutator having porting configured to control the flow of hydraulic fluid into the motor pockets;

wherein the rotor is configured to rotate about the first axis by rotation of the shaft and the stator is configured to rotate about the second axis in response to the pressure differential, and the stator is configured to orbit within an outer housing ring in response to the pressure differential such that the second axis orbits about the first axis; and wherein the shaft extends through the commutator through a shaft space that is eccentrically positioned through the commutator such that the commutator is eccentrically piloted about the first axis and the second axis by rotation of the shaft so that the commutator both rotates and orbits to control the flow of hydraulic fluid into the motor pockets.

2. The hydraulic motor of claim 1, further comprising an orbiting ring that is longitudinally fixed to the stator and radially fixed to the commutator, and a portion of the commutator extends longitudinally from the orbiting ring opposite to the stator.

3. The hydraulic motor of claim 2, wherein the stator, orbiting ring, and commutator comprise an orbiting assembly, and the housing ring defines an orbiting space in which the orbiting assembly orbits about the first axis.

4. The hydraulic motor of claim 1, wherein the rotor has a plurality of lobes and the stator has a plurality of vanes, and as the rotor rotates the lobes and vanes successively form the motor pockets for receipt and expulsion of the hydraulic fluid.

5. The hydraulic motor of claim 1, wherein the porting of the commutator comprises an inner commutator port configured to supply hydraulic fluid to the motor pockets at a first pressure, and an outer commutator port configured to supply hydraulic fluid to the motor pockets at a second pressure different from the first pressure to create the pressure differential between the motor pockets.

6. The hydraulic motor of claim 5, wherein a fluid pathway through the inner commutator port is isolated from a fluid pathway through the outer commutator port.

7. The hydraulic motor of claim 5, wherein the inner and outer commutator ports are shaped as kidney ports.

8. The hydraulic motor of claim 5, wherein the inner commutator port extends through an entire longitudinal thickness of the commutator.

9. The hydraulic motor of claim 8, wherein the outer commutator port extends partially through the longitudinal thickness of the commutator, and the commutator has a slot that forms a fluid pathway between the outer commutator port and an outer diameter of the commutator.

10. The hydraulic motor of claim 9, further comprising:

an orbiting ring that is longitudinally fixed to the stator and radially fixed to the commutator, and a portion of the commutator extends longitudinally from the orbiting ring opposite to the stator; and an outer housing ring;

wherein the stator, orbiting ring, and commutator comprise an orbiting assembly, and the housing ring defines an orbiting space in which the orbiting assembly orbits about the first axis; and wherein the slot forms a fluid pathway between the outer commutator port and the orbiting space.

11. The hydraulic motor of claim 5, wherein the commutator further defines a shaft space configured to receive an output shaft, and the shaft space is eccentrically positioned through the commutator.

12. The hydraulic motor of claim 5, further comprising a motor housing defining a first inlet configured to supply hydraulic fluid at the first pressure to the inner commutator port, and defining a second inlet configured to supply hydraulic fluid at the second pressure to the outer commutator port.

13. The hydraulic motor of claim 12, wherein the first inlet includes an inner ring port in fluid communication with the inner commutator port, and the second inlet includes an outer ring port in fluid communication with the outer commutator port.

14. The hydraulic motor of claim 5, wherein when the first pressure is a low pressure relative to the second pressure, the rotor is configured to rotate in a forward direction, and when the first pressure is a high pressure relative to the second pressure, the rotor is configured to rotate in a reverse direction.

15. The hydraulic motor of claim 1, wherein the commutator is configured to be piloted on an inner diameter by the first axis, and to be piloted on its outer diameter by the second axis.

16. The hydraulic motor of claim 1, further comprising an output shaft that is configured to be driven by the rotation of the rotor, wherein the output shaft is configured to be driven by the rotation of the rotor to rotate about the first axis without orbiting.

17. A commutator configured to control a flow of hydraulic fluid through a hydraulic motor, the commutator comprising:

porting configured to control the flow of hydraulic fluid, wherein the commutator defines a shaft space for receiving a shaft, the shaft space being eccentrically positioned through the commutator so that the commutator is eccentrically piloted about a first axis and a second axis different from the first axis by rotation of the shaft so that the commutator both rotates and orbits to control the flow of hydraulic fluid.

18. The commutator of claim 17, wherein the porting comprises an inner commutator port configured to supply hydraulic fluid to motor pockets of the hydraulic motor at a first pressure, and an outer commutator port configured to supply hydraulic fluid to the motor pockets at a second pressure different from the first pressure to create a pressure differential between the motor pockets.

19. The commutator of claim 18, wherein a fluid pathway through the inner commutator port is isolated from a fluid pathway through the outer commutator port.

20. The commutator of claim 18, wherein the inner commutator port extends through an entire longitudinal thickness of the commutator; and the outer commutator port extends partially through the longitudinal thickness of the commutator, and the commutator has a slot that forms a fluid pathway between the outer commutator port and an outer diameter of the commutator.

* * * * *